US005437313A

United States Patent [19]

Christe

[11] Patent Number: 5,437,313

[45] Date of Patent: Aug. 1, 1995

[54] WEFT THREAD DISTRIBUTION DEVICE FOR A SERIES SHED LOOM

[75] Inventor: Marcel Christe, Rüti, Switzerland

[73] Assignee: Sulzer Rueti AG, Rueti, Switzerland

[21] Appl. No.: 239,099

[22] Filed: May 6, 1994

[30] Foreign Application Priority Data

May 13, 1993 [EP] European Pat. Off. ..... 93810353

[51] Int. Cl.[6] ..... D03D 47/30

[52] U.S. Cl. ..... 139/28; 139/11

[58] Field of Search ..... 139/11, 28, 188 R, 436

[56] References Cited

U.S. PATENT DOCUMENTS

| | | | |
|---|---|---|---|
| 3,768,213 | 10/1973 | Asano | 51/165.78 |
| 4,388,951 | 6/1983 | Atkinson et al. | 139/28 X |
| 4,586,541 | 5/1986 | Steiner | 139/28 X |
| 4,592,393 | 6/1986 | Steiner | 139/28 X |
| 5,146,955 | 9/1992 | Steiner et al. | 139/11 |

FOREIGN PATENT DOCUMENTS 0143119 6/1985 Germany .

0433216 6/1991 Germany .

*Primary Examiner*—Andrew M. Falik

*Attorney, Agent, or Firm*—Townsend and Townsend Khourie and Crew

[57] ABSTRACT

A device for the distribution of weft yarns into weft ducts of a rotor of a series shed loom has a first part (7) rotating with the rotor (2) with transfer ducts (11) for the weft yarns and a second part (8) which is nonrotatable in relation to the rotor (2) and has connecting ducts (10) for the weft yarns. The parts (7, 8) are axially aligned and movable with respect to one another and energy storing devices (24) hold them in an operating position so that there is a gap between opposing faces of the first and second parts (7, 8). An adjustable support structure permits adjustment of the gap width and then keeps it constant. The second part is connected to an operating mechanism (3) which pulls the second part (8) into an open position to thereby provide access to the transfer and connecting ducts (10, 11) for the weft yarns.

9 Claims, 4 Drawing Sheets

WEFT THREAD DISTRIBUTION DEVICE FOR A SERIES SHED LOOM

BACKGROUND OF THE INVENTION

The present invention relates to a device for the distribution of weft threads and also to a series shed loom having a weft thread distribution device.

Published European application EP-A-433 216 discloses a device for the distribution of weft threads, which comprises a fixed part and a part rotating with the rotor, which are disposed axially and at a distance from one another so that there is a gap between the opposite faces of the parts. The fixed part is retained by energy storing devices in an operating position in order to perform, with low acceleration forces, the distribution of the weft threads and the transfer to the different weft ducts of a rotor.

This device has the great disadvantage that the removal of faults, e.g. weft thread breakages, clogging of the ducts by weft threads, is only possible with considerable expense and the gap between the parts cannot be adjusted.

SUMMARY OF THE INVENTION

An object of the present invention is to create a device for the distribution of weft threads which does not have the said disadvantage above.

This object is achieved in accordance with the invention an operating mechanism (3) for axially displacing the fixed part (8) in relation to the rotating part (7) against a spring force to thereby uncover the transfer and connecting ducts (10, 11) for the weft supply.

DESCRIPTION OF THE PREFERRED EMBODIMENTS

Figure 1:
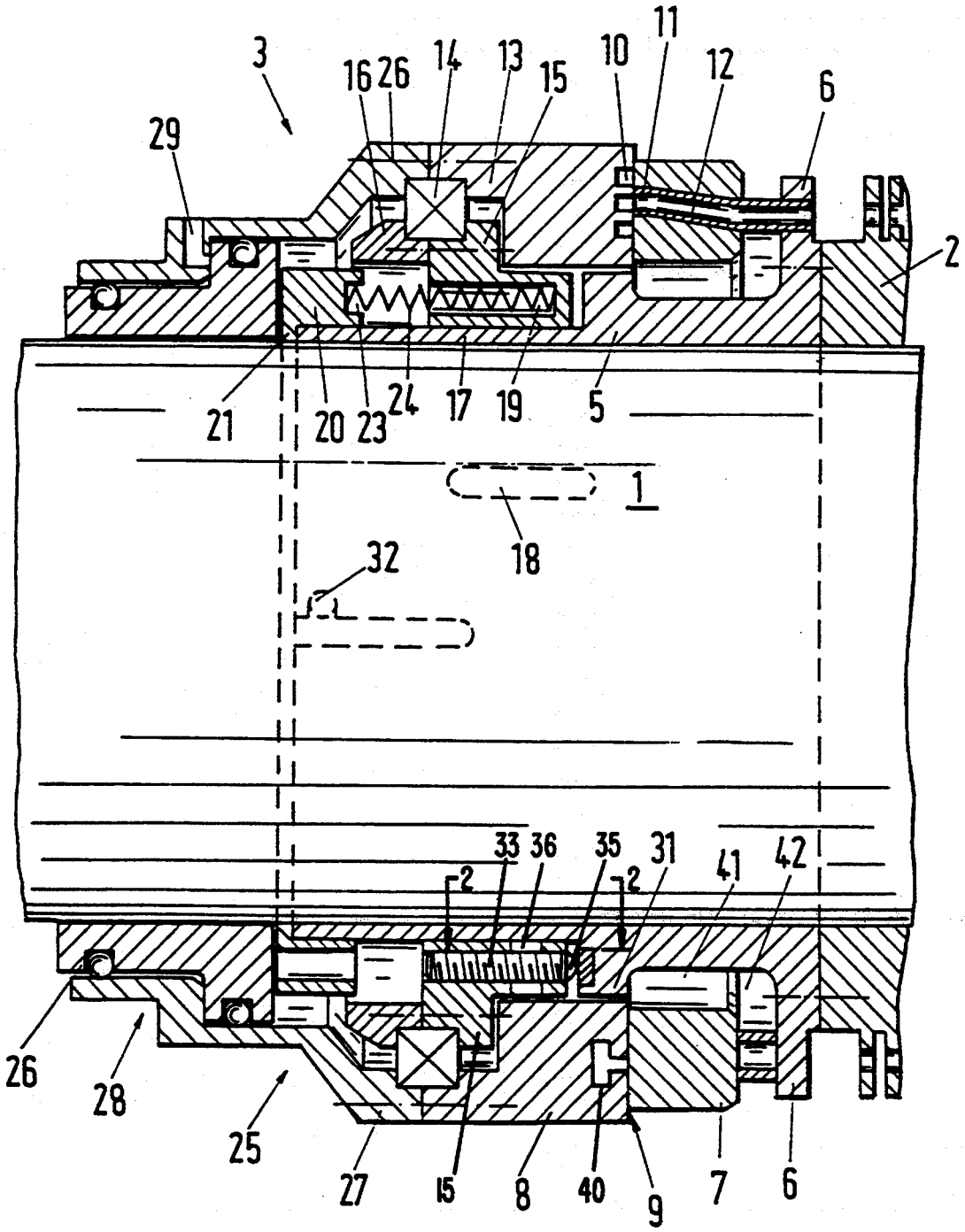
FIG. 1 shows a section of an embodiment of a device according to the invention in the operating position.
Figure 2:
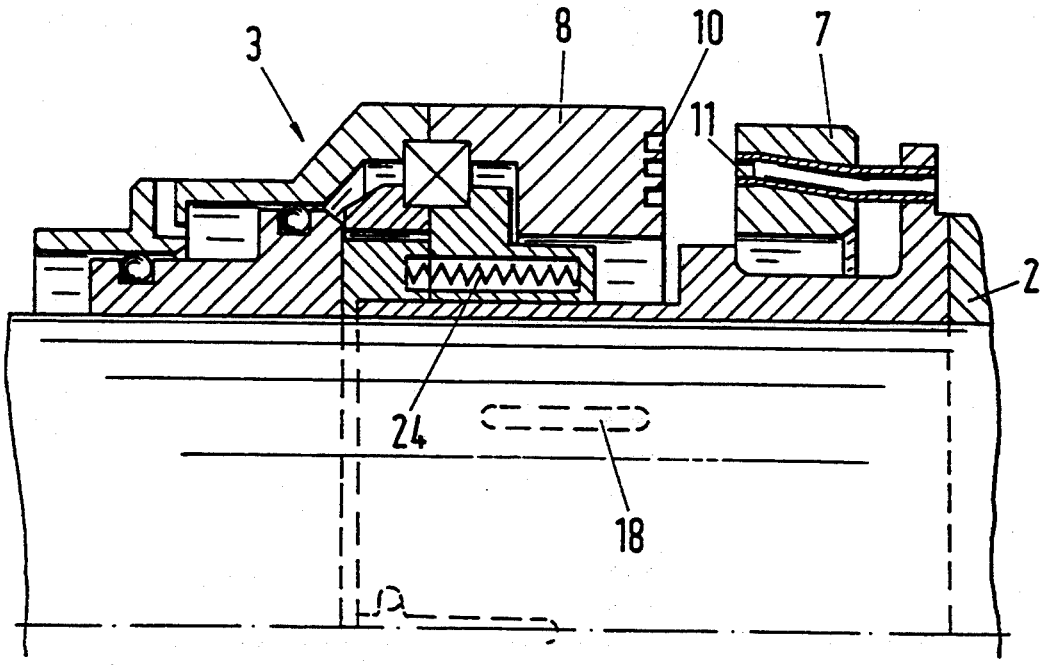
FIG. 2 shows the device of FIG. 1 in the position for the removal of faults and/or cleaning.

FIGS. 1 and 2 show a portion of a series shed loom having a shaft 1, a rotor 2 and a device for the distribution of weft threads.

The device comprises a substantially tubular housing part 5 having a flange 6, which is attached to the rotor 2 and rotates with the rotor 2.

The device contains an annular first part 7, which is attached to the flange and rotates with the rotor 2, and an annular second part 8, which is fixed with respect to the first part 7, which are disposed coaxially and at a distance from one another so that there is a gap 9 between the front faces lying opposite one another in order to avoid friction therebetween. The device also includes an operating mechanism 3 for displacing or opening the second part 8 out of an operating position (FIG. 1) into a position for the removal of faults (FIG. 2).

To perform the distribution of the weft threads, the opposite front sides of the first and second parts 7, 8 include channel-shaped recesses 10, 11 which are open to the front side in the form of arcs of circles. The recesses in the first part 7 are connected via a duct 12 to the rotor 2, while the recesses 10 in the second part 8 are connected via ducts (not represented) with thread supply devices (not represented either).

The second part 8 is pivoted on the operating mechanism 3, which is disposed in an axially displaceable manner in relation to the rotor 2. For this purpose the second part 8 has a projection 13 into which a rolling bearing 14 is inserted. The rolling bearing 14 is further disposed on a ring bearing 15 and retained thereon by means of a ring 16.

On its end opposite the flange 6, the housing part 5 has a cylindrical projection 17. The ring bearing 15 is disposed in an axially displaceable manner on this projection and is prevented from twisting by a wedge guide 18. This wedge guide 18 is at the same time used to guide operating device 3 with the second part 8 during tile axial displacement. In the ring bearing 15 are constructed six blind holes 19, which are equally spaced along a circular line. On the free end of the projection 17 is a clamping ring 20 which has a radially inwardly directed projection 21. The projection 21 of the clamping ring 20 abuts the front end of projection 17 and is secured by a pin 32, which is disposed in the clamping ring 20 and protrudes into a recess in the projection 17. The clamping ring 20 also includes blind holes 23 which are aligned with blind holes 19 in the ring bearing 15. Pressure springs 24 in blind holes 19, 23 retain the second part 8 connected to the ring bearing 15 in its operating position.

To displace the second part 8, the operating mechanism 3 comprises a piston arrangement having a housing part 25 and a piston 26. The housing part 25 is substantially a hollow cylinder with a first portion 27, which is bolted to the second part 8 and is mounted on the rolling bearing 14, and a second portion 28 in which the piston 26 is disposed so that it can move up and down.

The piston 26 has a hollow cylindrical portion having a sealing ring on the periphery and at one end a flange having a sealing ring on the periphery. The second portion 28 has two partial portions with different internal diameters, so that there is a shoulder in which an inlet duct 29 is constructed so that the sealing rings disposed at the hollow cylindrical section and at the flange tightly abut the inner faces of the partial portions and with the shoulder form an annular operating chamber, into which the inlet duct 29 opens.

As already mentioned, there is a gap 9 between the first and second parts 7, 8, if the latter assumes the operating position. To maintain and adjust this gap 9, the second part 8 is provided with three support units 30 which form a three-point support and abut a shoulder 31 on housing part 5. At the support point there is an insert member 32 made from hard metal.

Figure 3:
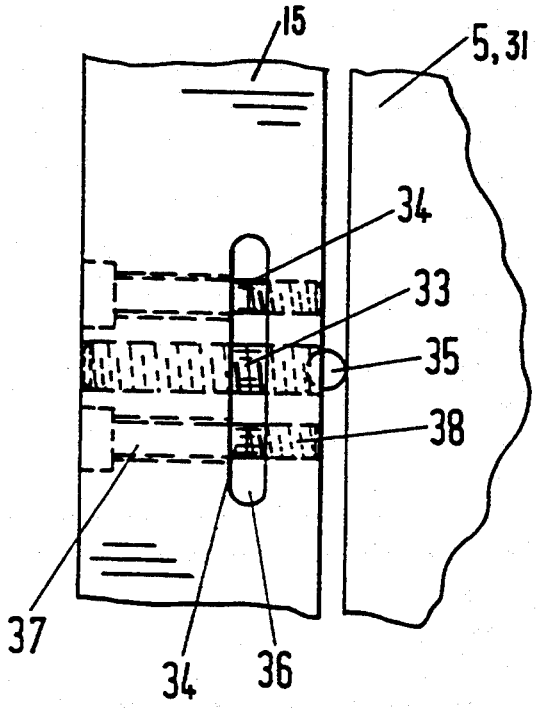
FIG. 3 is a fragmentary view taken along line 3—3 of FIG. 1 and shows an adjustable support unit for the second part.
Figure 4:
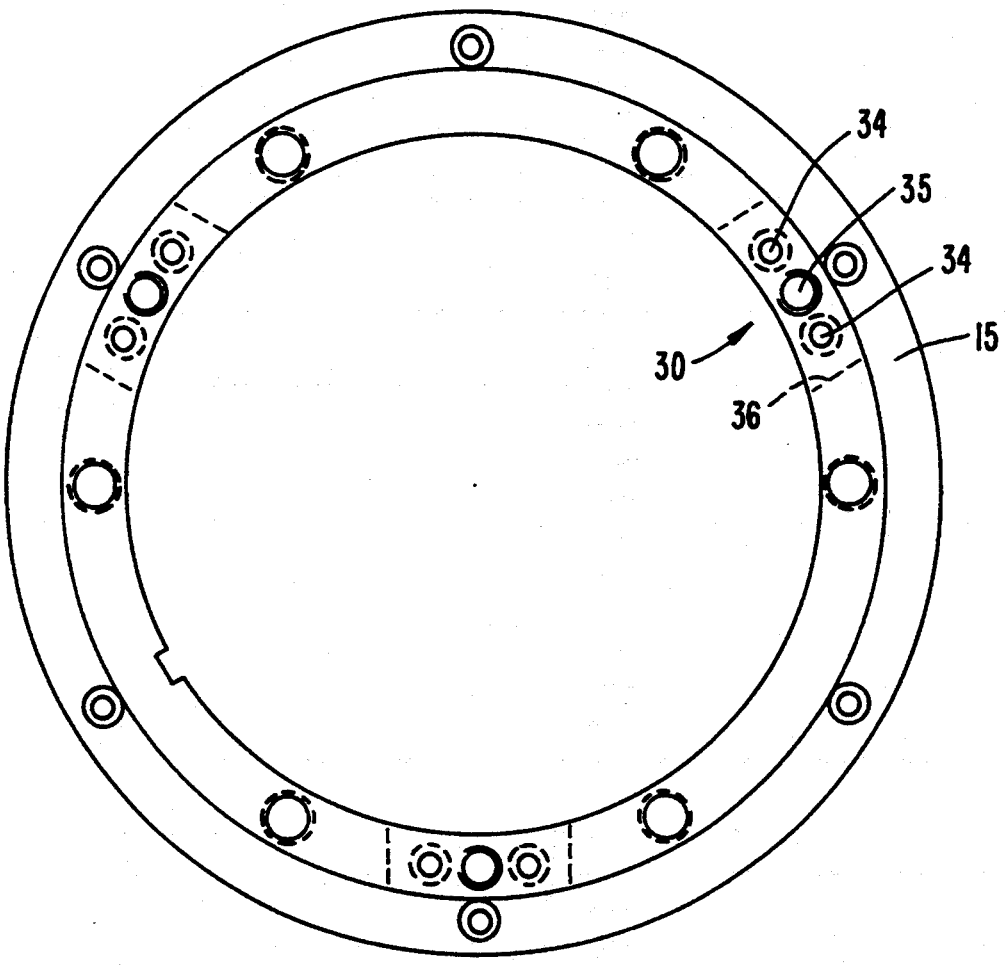
FIG. 4 is an end view of the ring which mounts the adjustable support structure shown in greater detail in FIG. 3.

As FIG. 3 shows, the support unit 30 consists of a supporting screw 33 and a ball 35, which is rotatably held at the free end of the supporting screw 33. The supporting screw 33 is screwed into a threaded bore (not represented) so that the ball 35 protrudes from the threaded bore. With the supporting screw 33 is associated an arrangement which includes two straining screws 34 and a slot 36, and which is located at the point on ring bearing 15 provided for the three-point support. The slot 36 penetrates the ring bearing 15 in the radial direction. The dimensions of the slot 36 are such that both the supporting screws 33 and also the straining screws 34 pass through the slot in the axial direction. The straining screws 34 are disposed on both sides of the supporting screws 33 and adjacent to the screw head comprise a shaft 37 and at the free end a threaded portion 38, which have such dimensions that the transition portion of the thread lies inside the slot 36. After the adjustment of the supporting screw 33, the slot can be deformed by means of the straining screws 34, i.e. its width can be reduced, as a result of which the clearance between the turns of the threaded bore in the ring bearing and the supporting screw screwed into it is abolished. In this manner a perfect and exact adjustment of the gap 9 with respect to the gap width and plane parallelism between the first and second part 7, 8 is guaranteed, and the supporting screw 33 is fixed and secured.

Between the annular first part 7 and the flange 6 on the one hand and the periphery of the housing part 5 on the other hand there is a radial or axial gap 41, 42. This measure effects an automatic removal of fiber fluff (FIG. 1).

To guarante a faultless distribution of the weft threads in a series shed loom a mechanism monitors the width of the gap 9 between the first and second parts 7 and 8. In a preferred embodiment as disclosed in allowed U.S. application Ser. No. 08/239,100 this mechanism includes a sensor nozzle 40 which senses changes in the dynamic pressure in gap 9 as a result of changes in the width of the gap.

The mode of operation of the device described above is explained below.

FIG. 1 shows the device in its operating position in which the rotor 2, the housing part 5, the first part 7, the ring bearing 15, the ring 16 and the clamping ring 20 rotate. The second part 8 and the piston arrangement are stationary. The weft threads are supplied via the stationary second part 8 and inserted by the rotating first part 7 into the weaving sheds (not represented).

By eliminating of the clearance between the turns, a precise adjustment of the gap between the first and second parts 7, 8 in the magnitude of 0.01 mm becomes possible. Once set, the gap is maintained because of the fixing of the supporting screws 33. As a result a faultless supply of weft yarn with little loss of air is gauranteed.

Faults, e.g. mispicks, are readily corrected by placing the device in the open position, shown in FIG. 2. The second part 8 is displaced with the piston arrangement by supplying the annular working chamber with a pressurized medium, preferably compressed air. The compressed air flowing through the inlet duct 19 into the operating chamber forces the piston 26 against the clamping ring 20 and then pulls the housing part 25 and the second part 8 bolted thereto away from the first part 7. At the same time the ring bearing 15 is retracted against the action of the pressure springs 23. Thus the transfer and connecting ducts 10 and 11 are uncovered. After the removal of a fault the second part 8 is advanced by the pressure springs 23 by reversing the compressed air supply until the support units abut the insert members.

To pull the piston 26 away from the clamping ring 20, negative pressure is produced in the annular working chamber by means of an injector (not represented), as a result of which the piston 26 comes to abut the shoulder of the second portion 28 and no friction occurs between the piston and the clamping ring 20. After this readjustment the parts 7, 8 again assume the previous position, i.e. separated by the gap.

What is claimed is:

1. A device for the distribution of weft threads onto weft ducts of a rotor of a series shed loom having an air-jet picking system, the device comprising a first part including a first axially oriented face (7) rotating with the rotor (2) and having a number of transfer ducts (11) for the weft yarns, a second part (8) which is rotatable and axially displaceable in relation to the first part and includes a second axially oriented face and a number of connecting ducts (10) for the weft yarns, at least one rolling bearing (14) coaxially mounting the first and second parts so that the first and second faces are opposite each other, means for biasing the first and second parts towards each other into an operating position and for maintaining a gap (9) between the first and second faces, and an operating mechanism (3) for axially displacing the second part (8) in relation to the first part (7) against a force generated by the biasing means to thereby uncover the transfer and connecting ducts (10, 11) for the weft yarn.

2. A device according to claim 1 wherein the operating mechanism (3) comprises a piston arrangement (25–28) which includes means for pressurizing a portion of the piston arrangement with a fluid for axially displacing the second part (8) with respect to the first part (7).

3. A device according to claim 1 wherein the biasing means are disposed in the operating mechanism (3) for returning the second part (8) into the operating position.

4. A device according to claim 1 including a mechanism for keeping a distance between the first and second faces of the first and second parts (7, 8) to form the gap (9).

5. A device according to claim 4 wherein the mechanism comprises at least three support units (30) which form an at least three-point support between the first and second faces.

6. A device according to claim 5 including means for adjusting the support units (30) to thereby adjust a width of the gap (9).

7. A device according to claim 5 wherein each support unit (30) includes means for eliminating play within the support unit and securing it in a predetermined position.

8. A series shed loom including a supply of weft yarns, a rotor, an air jet picking system for the weft yarns, a first part including a first, axially oriented face rotating with the rotor and having a number of transfer ducts for the weft yarns, a second part which is rotatable and axially displaceable in relation to the first part and includes a second, axially oriented face and a number of connecting ducts for the weft yarns, a bearing coaxially mounting the first and second parts so that the first and second faces are opposite each other, means for biasing the first and second parts towards each other into an operating position and for maintaining a gap between the first and second faces, and an operating mechanism for axially displacing the second part in relation to the first part against a force generated by the biasing means to thereby uncover the transfer and connecting ducts for the weft supply.

9. A series shed loom according to claim 8 including a mechanism for monitoring a dynamic pressure in the gap (9) between the first and second faces.

* * * * *